US008105111B2

(12) United States Patent
Chen

(10) Patent No.: US 8,105,111 B2
(45) Date of Patent: Jan. 31, 2012

(54) ELECTRICAL CONNECTOR ASSEMBLY HAVING IMPROVED SHIELDING SHELL

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 35 days.

(21) Appl. No.: 12/797,637

(22) Filed: Jun. 10, 2010

(65) Prior Publication Data

US 2011/0053416 A1 Mar. 3, 2011

(30) Foreign Application Priority Data

Aug. 31, 2009 (CN) ..... 2009 2 0309269
Sep. 29, 2009 (CN) ..... 2009 2 0311822

(51) Int. Cl.
*H01R 13/648* (2006.01)

(52) U.S. Cl. ..... 439/607.04

(58) Field of Classification Search ..... 439/607.01, 439/607.04, 607.13, 607.14
See application file for complete search history.

(56) References Cited

U.S. PATENT DOCUMENTS 7,402,081 B2 * 7/2008 Si et al. ..... 439/607.04
7,927,142 B2 * 4/2011 Wang et al. ..... 439/607.04

FOREIGN PATENT DOCUMENTS

TW M305468 1/2007

* cited by examiner

*Primary Examiner* — Khiem Nguyen
(74) *Attorney, Agent, or Firm* — Wei Te Chung; Andrew C. Cheng; Ming Chieh Chang

(57) ABSTRACT

An electrical connector includes an insulative housing having a longitude base with a plurality of contacts retained therein in a first direction, a pair of opposite arms extending from ends of the longitude base in the first direction and a shielding shell includes a top plate and a bottom plate covering on the housing. A receiving space is enclosed with the top plate, the bottom plate of the shielding shell and the pair of arms of the insulative housing. An arm-limited means is unitarily formed on the shell to abut against inside face of the pair of arms.

10 Claims, 10 Drawing Sheets

ELECTRICAL CONNECTOR ASSEMBLY HAVING IMPROVED SHIELDING SHELL

BACKGROUND OF THE INVENTION

1. Field of the Invention

The present invention relates to an electrical connector assembly, and more particularly to an electrical connector assembly with an improved shielding shell.

2. Description of the Related Art

TW Patent No. M305468 issued on Jan. 21, 2007 discloses an electrical connector. The connector includes a longitude insulative housing with a pair of arms extending from both end of the housing and a shielding shell enclosing the insulative housing mainly with a top wall and a bottom wall. The shell also defines lock means to fasten the top wall, the bottom wall and the housing together in vertical direction and in outer horizontal direction. However, the strength of this pole-like insulative housing is poor and there is no limit on the arms in inner horizontal direction, the arms of the insulative housing could be distorted in shape inwardly when heated.

In view of the above, a new electrical connector assembly that overcomes the above-mentioned disadvantages is desired.

SUMMARY OF THE INVENTION

Accordingly, an object of the present invention is to provide an electrical connector assembly with an improved shielding shell.

To fulfill the above-mentioned object, an electrical connector, comprises an insulative housing having a longitude base with a plurality of contacts retained therein in a first direction, a pair of opposite arms extending from ends of the longitude base in the first direction and a shielding shell includes a top plate and a bottom plate covering on the housing. A receiving space is enclosed with the top plate, the bottom plate of the shielding shell and the pair of arms of the insulative housing. An arm-limited means is unitarily formed on the shell to abut against inside face of the pair of arms.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Figure 1:
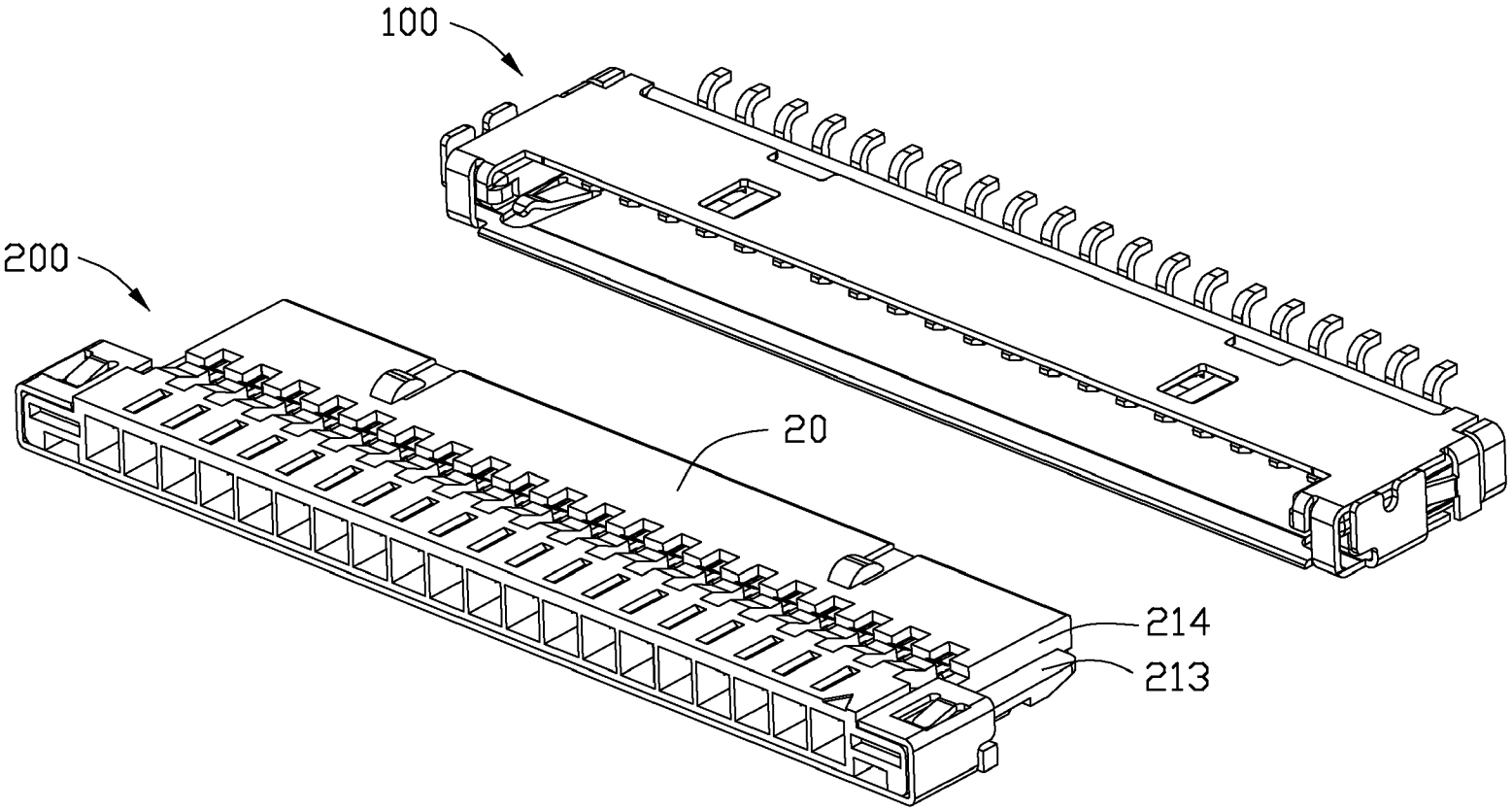
FIG. 1 is a perspective view of the electrical assembly of the present invention.

Reference will now be made to the drawings to describe the present invention in detail.

Referring to FIGS. 1-4, the present invention relates to an electrical assembly including a board-end receptacle connector 100 and a cable-end plug connector 200 with a longitude plug port 20 for mating with the receptacle connector 100.

Referring to FIGS. 5-8 illustrating the receptacle connector 100, the receptacle connector 100 comprises an inversed '[' shaped insulative housing 10, a plurality of contacts 11 accommodated in the housing 10 and a shielding shell 12 assembled to the housing 10. Said housing 10 comprises a longitude base 101 with a number of contact channels 1011 running therethrough in a first direction to retain the contacts 11 thereon and a pair of opposite arms 103 extending from both end of the base 101 in the first direction. The shielding shell 12, which is formed with one continuous metal plate, includes a top plate 121, a bottom plate 123 and two side plates 126 connecting with the top and bottom plate to commonly surround the insulating housing 10. A receiving space 105 is enclosed with the top plate 121, the bottom plate 123 and the pair of arms 103. The top plate has a pair of spring piece 128 extending in the receiving space 105 adjacent to the arm 103. A pair of joining pieces 125 connecting with the top plate and bottom plate at the front edges near to the arm are provided to abut against the front faces of the arm.

The arm 103 of insulative housing 10 has a supporting portion 1031 at a lower portion thereof and a limited portion 1032 at an upper portion thereof. The supporting portion 1031 has an upward face 1034 cooperating with the pair of spring pieces 128 to engage with the latch rib 213 (labeled in FIG. 1) of the plug connector 200 and the limited portions 1032 are engaging with the end faces 214 (labeled in FIG. 1) of the plug connector 200. Please note that the joining pieces 125 are pressed against the supporting portions 1031 since the supporting portion 1031 is longer than the limited portion 1032 in the first direction. One recess 1033 is defined at an upper portion of a front end of each supporting portion 1031, which opens upwards and forwards. A pair of holding pieces 127 unitarily extending from a front edge of the bottom plate 123 near to the joining pieces 125 are retained in the recess 1031. The holding piece 127 includes an upright portion 1271 extending from the bottom plate and a horizontal portion 1272 bending inside to receive in the recess 1033. The holding pieces 127 are separated from the joining piece 125 so that the pair of arms 103 can be well engaged to prevent from deforming inwardly. What's more, the part of this holding pieces 127 that shields the front end of the arms can well protect the insulative housing when mating with plug connector 200, and the holding pieces 127 are extending from the shielding shell 12 separately instead of extending from the joining pieces 125, which is to avoid related distortion to the whole shielding shell 12.

The front ends 111 of the contacts 11 project in the receiving space 105. The top plate 121 further forms a pair of solder pads 129 bent on the outer side of the arm 103 and near the free end of corresponding arm 103, which can engage the entire receptacle connector 100 firmly on a PCB board.

Figure 2:
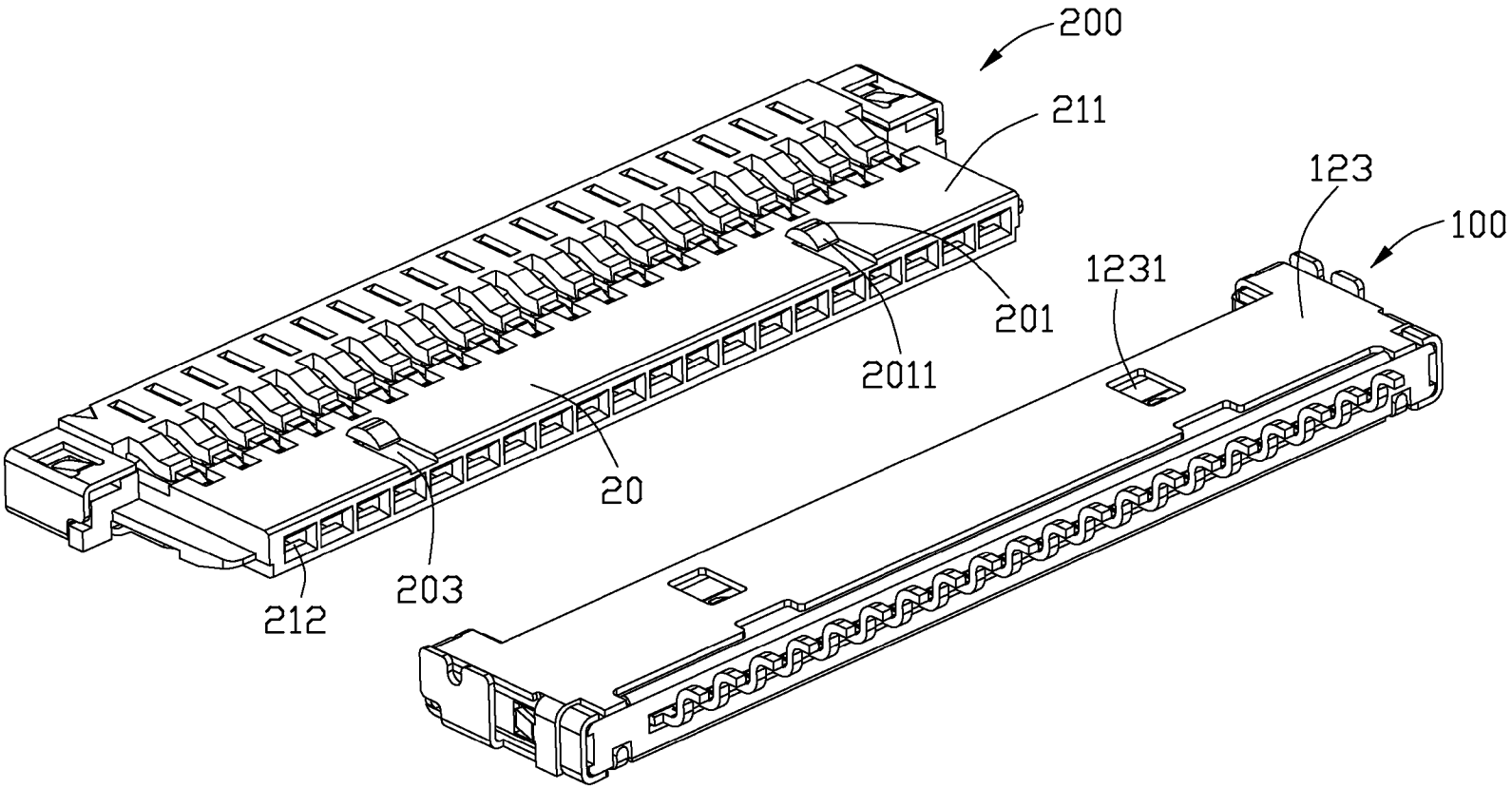
FIG. 2 is an another perspective view of the electrical assembly of the present invention.
Figure 3:
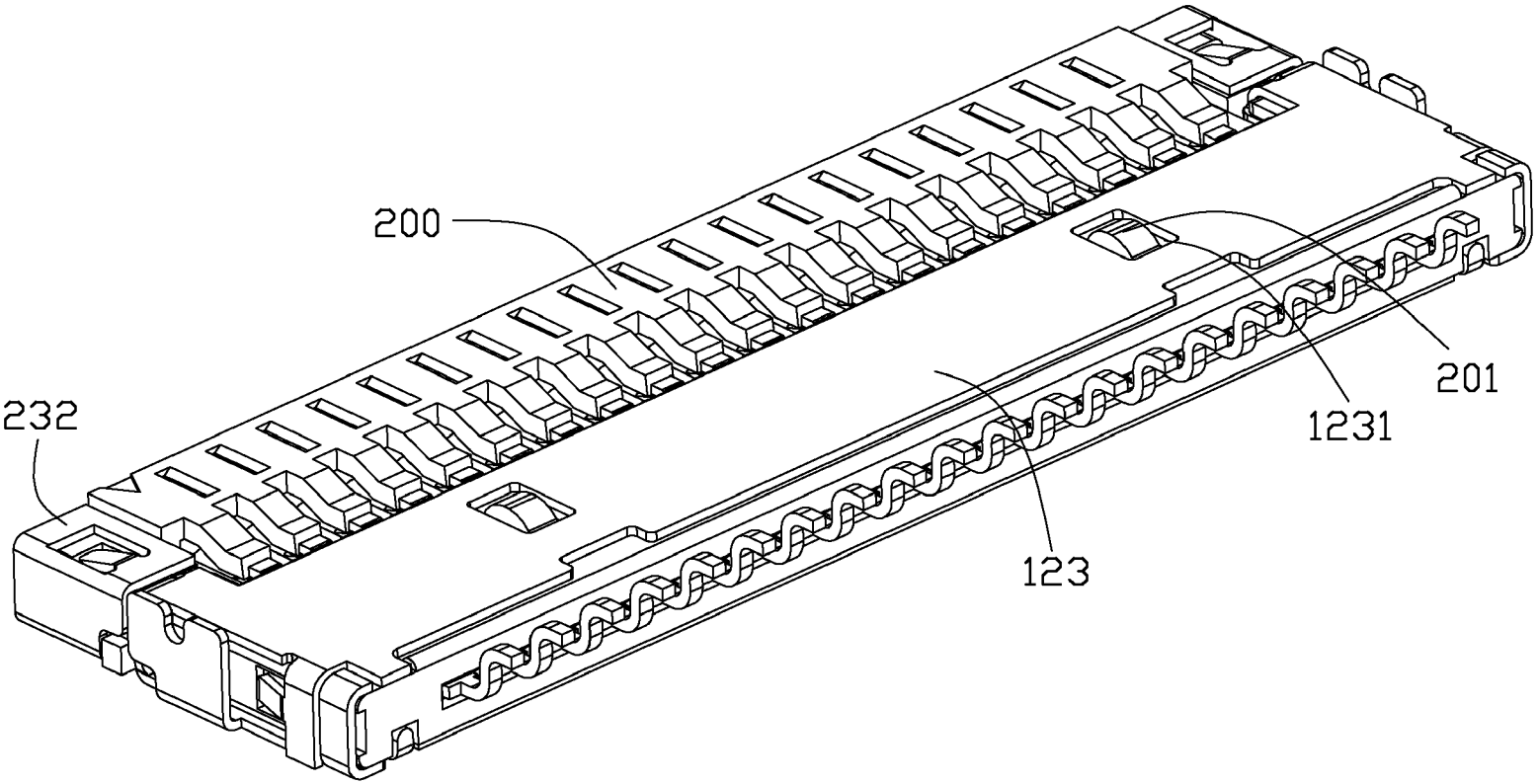
FIG. 3 is a perspective view of the assembled electrical assembly of the present invention.
Figure 4:
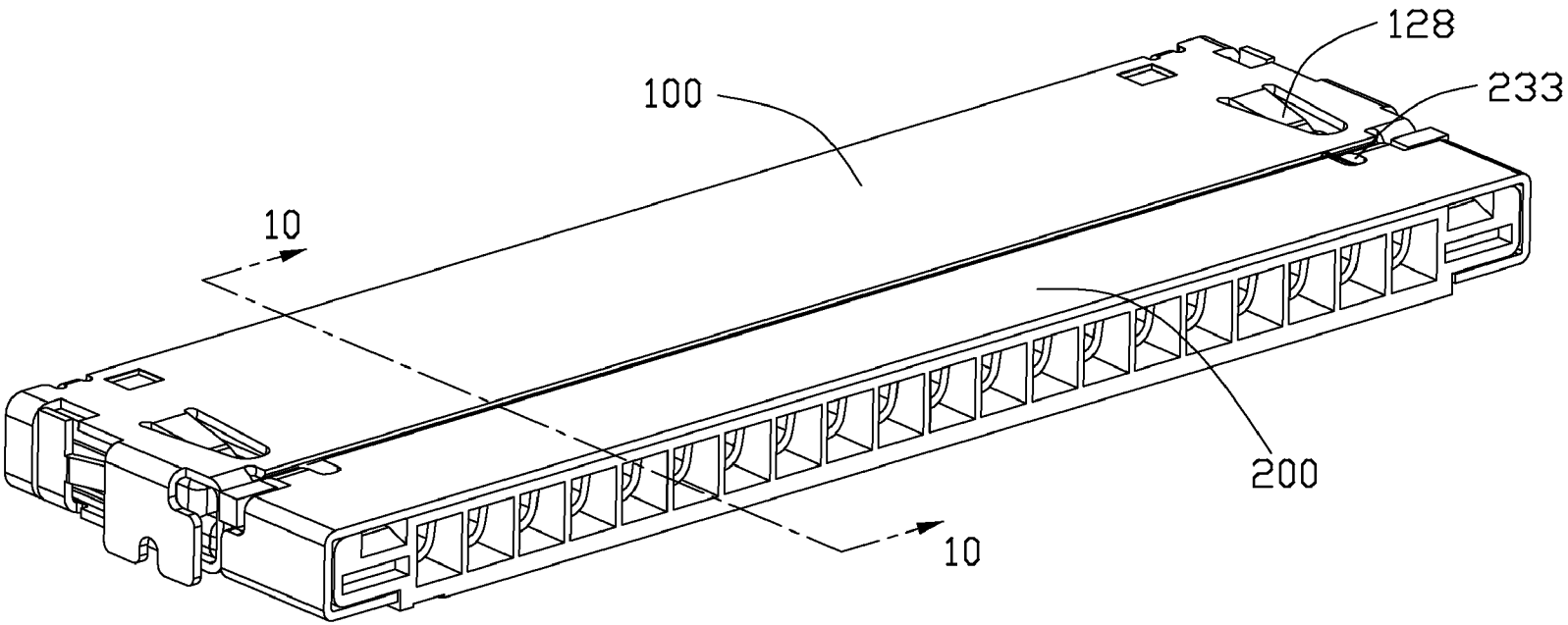
FIG. 4 is an another perspective view of the assembled electrical assembly of the present invention.
Figure 5:
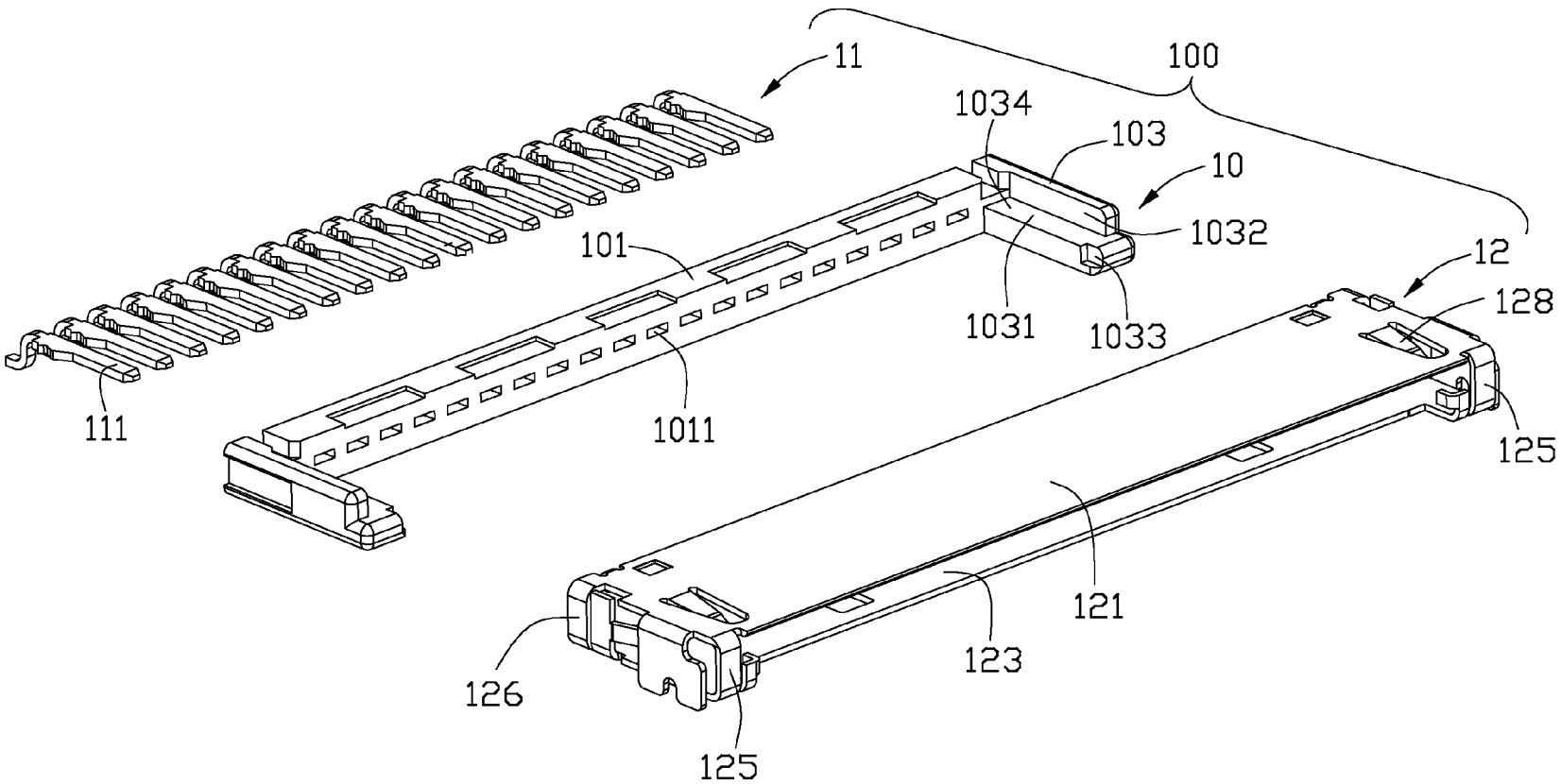
FIG. 5 is an exploded view of the receptacle connector of the present invention.
Figure 6:
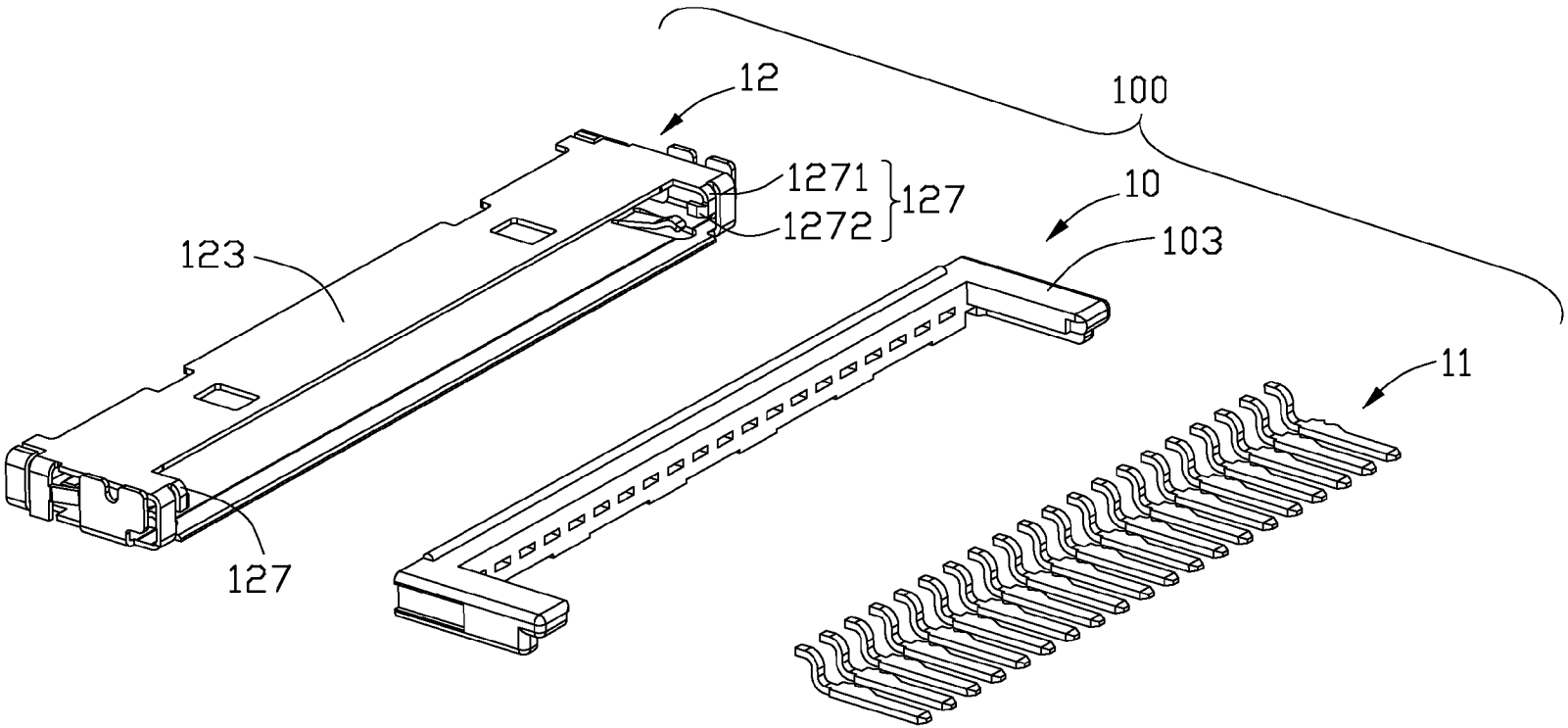
FIG. 6 is an another exploded view of the receptacle connector of the present invention.
Figure 7:
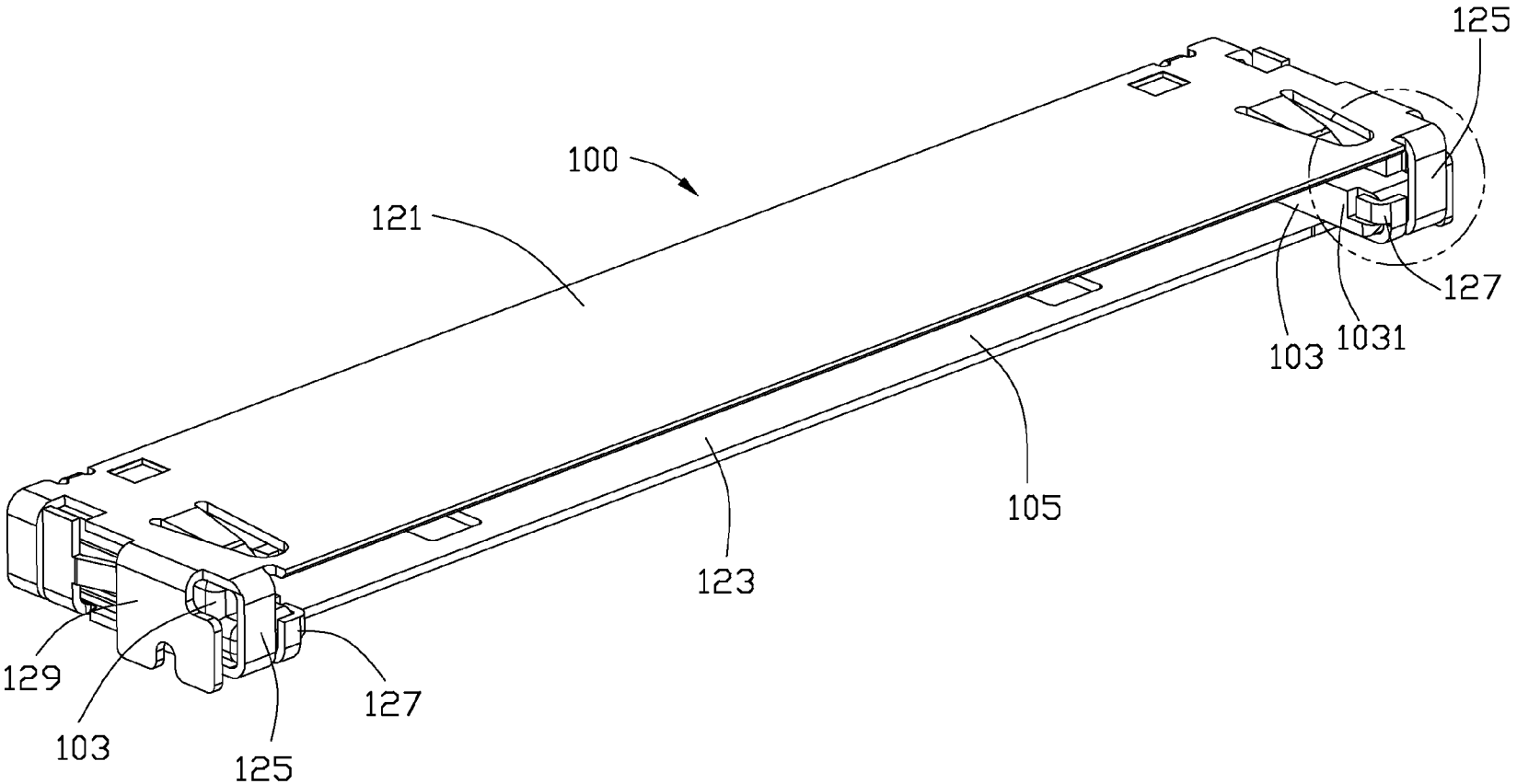
FIG. 7 is a perspective view of the receptacle connector of the present invention.
Figure 8:
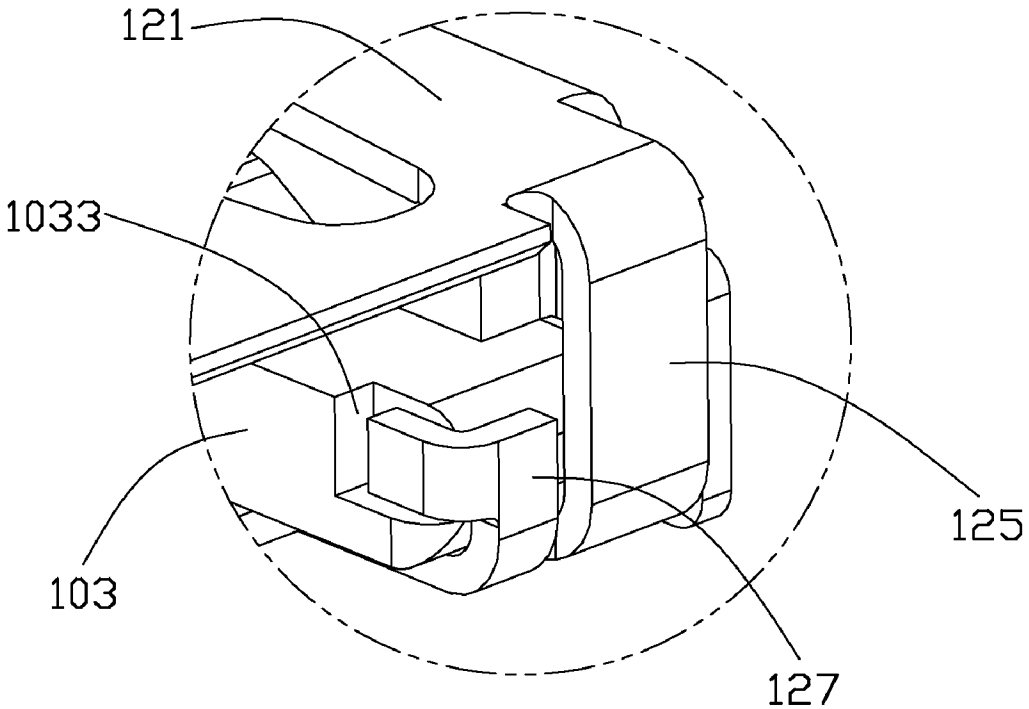
FIG. 8 is an enlarged perspective view of the receptacle connector as shown in circle in FIG. 7.
Figure 9:
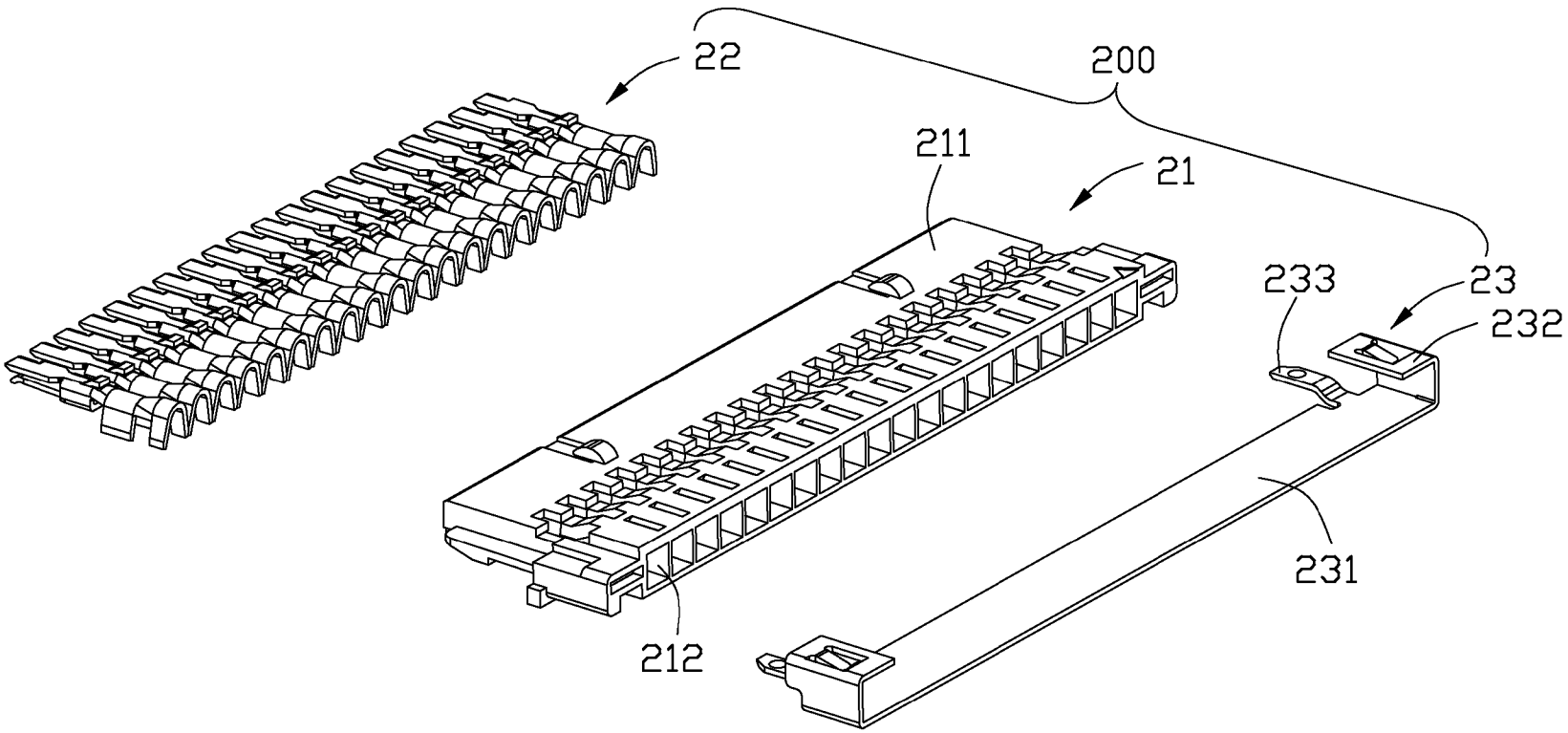
FIG. 9 is an exploded view of the plug connector of the present invention.
Figure 10:
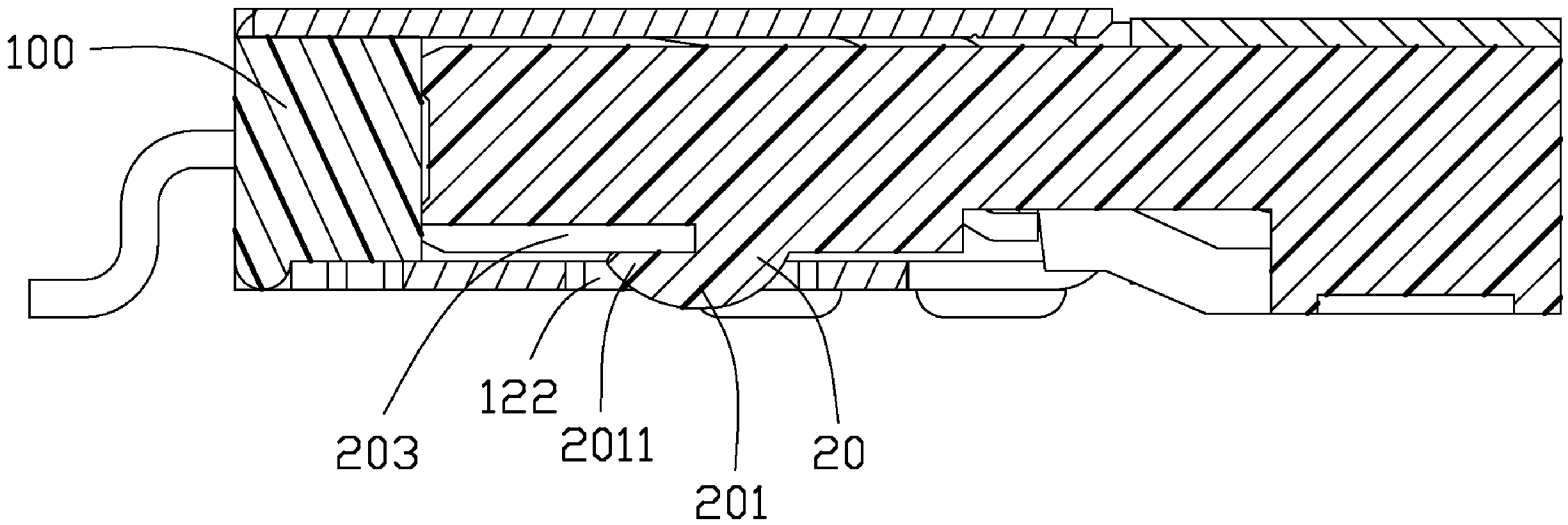
FIG. 10 is a cross sectional view of the electrical assembly taken along line 10-10 in FIG. 4.

Referring to FIG. 9 illustrating the plug connector 200, the plug connector includes an insulative housing 21 with a longitude base 21 and the plug port 20 extending frontward from the base 21. A top face 211 and a bottom face is defined on the insulative housing 21. A plurality of receiving holes 212 labeled in FIG. 2 are defined and run through in the first direction. A plurality of contacts 22 are received in the receiving holes 212 so that the front ends 111 of the contacts 11 of the receptacle connector 100 are inserted to the receiving holes 212 to contact with the contacts 22 of the plug connector 200. A metal shell 23 includes a top panel 231 covering on the bottom face of the insulative housing 21, a bending end plate bending to the top face of the insulative housing to retaining the shell to the housing as best shown in FIG. 3 and a pair soldering legs 233 extending forward which can be engage with the bottom plate of the receptacle connector 100 as best shown in FIG. 4.

Referring to FIGS. 1-4 and 10 illustrating the engagement of the receptacle connector 100 and the plug connector 200, the plug connector 200 defines a pair of cam portion 201 with guiding slants 2011 projecting on the top face 211 of the insulative housing and a groove 203 below the cam portion and extending through a front face thereof The bottom plate 123 of the receptacle connector defines a pair latching holes 1231 thereon. When mating, the top face 211 is inserted in the bottom plate 123 and the cam portions 211 are pressed downward to the grooves 203 to overcome the bottom plate 123 and into the latching holes 1231 and then the cam portions deflect and lock in the holes 1231. In this new design, cam portion 201 can be well protected under the bottom plate 123 without opening to the outer space and the cam portion 201 can also have better flexibility so that the plug port 20 can easily insert into the receiving space 105 without hard damage to the shielding shell 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising: an insulative housing comprising a longitude base with a plurality of contacts retained therein in a first direction and a pair of opposite arms extending from ends of the longitude base in the first direction; and a shielding shell comprising a top plate and a bottom plate covering on the insulative housing; a receiving space enclosed with the top plate, the bottom plate of the shielding shell and the pair of arms of the insulative housing; arm-limited means being unitarily formed on the shell to abut against inside face of the pair of arms; wherein the arm-limited means is a pair of holding pieces extending from a front edge of the bottom plate and pressed against the inside faces of the pair of arms.

2. The electrical connector as claimed in claim 1, wherein the arms define a pair of recesses thereon to receive holding pieces.

3. The electrical connector as claimed in claim 2, wherein each holding piece includes an upright portion extending from the bottom plate and a horizontal portion bending inwards to received in the recesses.

4. The electrical connector as claimed in claim 3, wherein a pair of joining pieces connecting with the top plate and bottom plate at the front edges near to the arms are provided to abut against front faces of the arms, the pair of holding pieces is formed near to the joining pieces.

5. The electrical connector as claimed in claim 4, wherein a pair of solder pad of the shielding shell bent on outer sides of the arms.

6. The electrical connector as claimed in claim 5, wherein the top plate has a pair of spring pieces extend in the receiving space adjacent to the arms.

7. The electrical connector as claimed in claim 6, wherein each arm defines a supporting portion at an inner and lower portion thereof, the recesses open upward and forward.

8. An electrical connector assembly, comprising: a receptacle connector comprising: an insulative housing with a longitude base and a pair of opposite arms extended from ends of the longitude base; and a shielding shell comprising a top plate and a bottom plate; and a receiving space enclosed with the top plate, the bottom plate of the shielding shell and the pair of arms of the insulative housing; and a plug connector comprising: a plug port mating with the receiving space; wherein arm-limited means is unitarily formed on the shell to prevent the arms from deforming inward; wherein a pair of latching holes is formed on the bottom plate of the receptacle connector and a pair of cam portions is projected on a top face of the plug connector to latch with the holes, a groove is defined below each cam portion which extends through a front face of the olua connector.

9. An electrical connector assembly comprising: a first connector including a first insulative housing defining opposite external upper and bottom surfaces with therebetween a plurality of first passageways each extending in a front-to-back direction; a plurality of first contacts disposed in the passageways, respectively; at least one cam portion formed one the first housing and extending upwardly above one of said external upper and bottom surfaces; and a groove formed in said one of the external upper and bottom surfaces and under the cam portion for provision of resiliency of said cam portion; a second connector including a second insulative housing; a metallic shell enclosing said second housing to define a mating cavity therein; a plurality of second contacts disposed in the second housing, each of said second contacts including a contacting sections forwardly extending into the mating cavity; wherein the metallic shell defines a through opening which compliantly receives the cam portion therein with a tip of the cam portion extends above the metallic shell when the first connector and the second connector mate with each other under condition that the first housing is inserted into the mating cavity, and the contacting sections of the second contacts are inserted into the corresponding passageways of the first housing for mechanically and electrically connecting to first contacts, respectivelyl wherein said first connector further includes another metallic shell essentially covering a rear portion of the housing and essentially not overlapped with said metallic shell during mating in a vertical direction, wherein said another metallic shell includes unitarily means for limiting inward movement of a corresponding arm of the first housing.

10. The electrical connector assembly as claimed in claim 9, wherein said groove extends forwardly toward the second housing.

* * * * *